US005855382A

United States Patent [19]

Reilly et al.

[11] Patent Number: 5,855,382

[45] Date of Patent: Jan. 5, 1999

[54] ROLLER SKATE LIGHTING DEVICE

[76] Inventors: James J. Reilly; John T. McCabe, III, both of 4157 NW. 90th Ave., Coral Springs, Fla. 33065

[21] Appl. No.: 683,224

[22] Filed: Jul. 18, 1996

[51] Int. Cl.[6] ..... A63C 17/26

[52] U.S. Cl. ..... 280/11.19; 280/11.22; 362/103; 362/459

[58] Field of Search ..... 280/11.19, 11.2, 280/11.22, 11.23, 11.27, 11.28, 816; 362/103, 190, 191, 194, 206, 61, 78, 800, 253, 811, 35, 240, 249, 251, 252

[56] References Cited

U.S. PATENT DOCUMENTS 4,240,132 12/1980 Wickman ..... 362/103
5,067,058 11/1991 Standley ..... 562/190
5,456,478 10/1995 Hsu et al. .
5,484,164 1/1996 McInerney et al. .
5,588,734 12/1996 Talamo et al. ..... 362/103
5,673,502 10/1997 Caterbone ..... 362/103

*Primary Examiner*—Richard M. Camby
*Attorney, Agent, or Firm*—Malin, Haley, DiMaggio & Crosby, P.A.

[57] ABSTRACT

A lighting device for use on roller skates and the like that attaches to the lower portion of a skate and provides a bright colorful light source to make a skater more visible in low light level conditions. The device is a light bar or strip that is battery powered. The light bar is a clear acrylic bar of various preselected colors having a light source at one end. The light is transmitted through the bar producing a light stick of nearly any color. An alternate embodiment uses an electro-luminescent light strip. The light bar or strip and battery power source is quickly and easily attached to any skate by a small strap and screw or by a strap having hook and loop type fasteners.

9 Claims, 6 Drawing Sheets

Fig. 4A
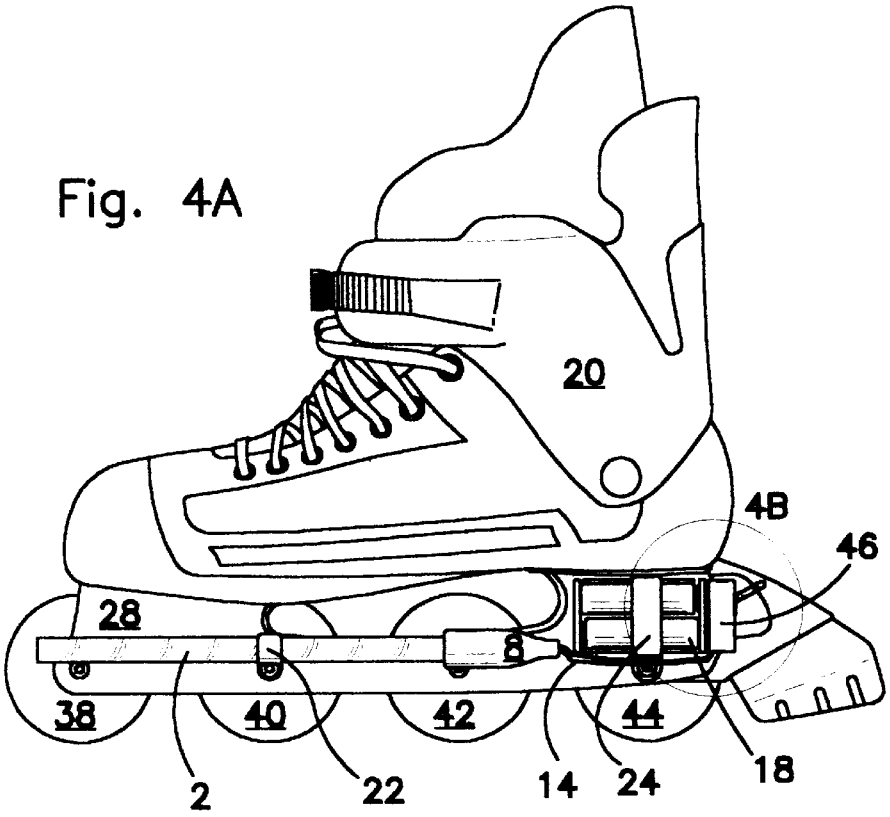
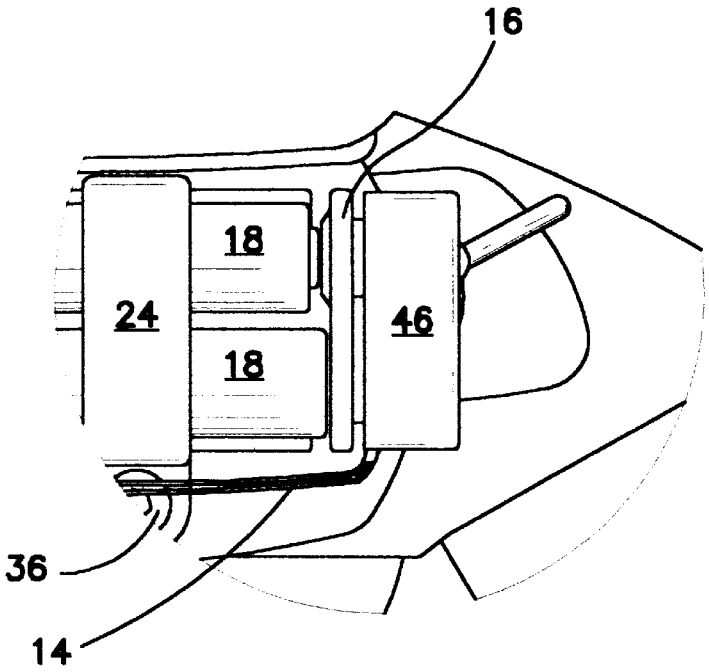
Fig. 4B

ROLLER SKATE LIGHTING DEVICE

BACKGROUND OF THE INVENTION

1. Field of the Invention

This invention relates to roller skate novelty and safety lighting systems, and more particularly to a roller skate lighting device that attaches to roller skates and especially in-line roller skates to announce the presence of roller skaters in low light conditions.

2. Description of Related Art

The use of roller skates, especially in-line roller skates, is extremely popular and results in use of roller skates at dusk and into the night. Skaters presently can use reflective material and flashlights to provide better visibility of themselves to passing motorists during conditions of low light levels. However, reflective material provides only limited protection especially during the dusk hours when some motorists may not have their lights on. Carrying flashlights is inconvenient and typically are only carried when the skater plans on skating after dark. A skater staying out a little later than planned will generally be without a light.

Attempts have been made to address the problem of skater visibility in such devices as that of U.S. Pat. No. 5,456,478 to Hsu et al. (Hsu), the disclosure of which is incorporated herein by reference. Hsu's device consists of magnets and coils used to activate light emitters fixed on both sides of each skate roller. The magnets are mounted on two elongate locating plates fixed on both sides of each roller and attached to the inner sides of an elongate inverted U-shaped plate fixed under a skating shoe. Light emitters are electrically connected with related coils mounted on the rollers. As each roller rotates, the coil crosses the magnetic field of the magnets inducing an electric current in each coil which causes the light emitters to light. (Hsu at col. 1, lines 17–24).

The Hsu device requires disassembly of the skate and installation of special rollers having coils and light emitters attached, installation of magnets, installation of elongate members to hold the magnets, installation of a U-shaped elongate member to hold the elongate magnet mounting members, and installation of various fasteners etc. to hold things together. If the device of Hsu is not built into the skate during manufacturing, it will require the user to replace the rollers and many other parts of the skate. This is not only inconvenient, but expensive.

In addition, the wheels of the Hsu device rotate within the U-shaped mounting member, which must necessarily cover the lighted portion of the roller for at least some portion of the roller's rotation. The only time the light emitting device of the roller is completely free of the U-shaped member is during the time the light emitting device is below the U-shaped member. (Hsu at FIG. 3). Hence, the position of the U-shaped member effectively restricts the amount and location of light that can seem from the light emitters in the rollers.

Another attempt to make skaters more visible in low light conditions is U.S. Pat. No. 5,484,164 to McInerney et al. ('164), the disclosure of which is incorporated herein by reference. The device of '164 comprises a skate having a headlight, brake light, several lights mounted in various configurations around the skate boot, and a battery power source. ('164 at col. 2, lines 10–60). Attachment of the lights to the skate boot is accomplished by provisions made in the boot during the manufacturing process. While mention is made in the '164 disclosure of other methods of attaching the lights, such as gluing or sewing, there is no disclosure of how that might be accomplished. Even if the lights were attached in some manner other than during manufacturing, the only guidance given for running the wires is by molding into the boot. ('164 at col. 2, lines 56–60). Furthermore, the method of attachment of the brake light circuit is given as embedding in the skate boot during the manufacturing process. ('164 at col. 3, lines 10–12). Finally, the pocket provided for the battery pack must be provided for during manufacturing process. ('164 at FIG. 4).

Assuming the lights of the '164 device were able to be installed on a skate boot after manufacturing, the difficulty of attaching the lights and running the wires would take the installation process outside the abilities of most skate owners, as well as being time consuming and expensive for anyone.

Therefore, there exists a need for an after market roller skate lighting system that is easy to install on most roller skates with little or no modifications, is effective, and inexpensive.

SUMMARY OF THE INVENTION

The present invention is a light bar, tube, or strip that produces a bright, unobstructed, and colorful light on either side or both sides of a roller skate providing high visibility in low light conditions. The light bar or strip is inexpensive and can be quickly and easily installed on most roller skates.

The bright light bar or light strip of the present invention is mounted on either side of a roller skate near the wheels and parallel to the direction of travel. The light bar of the present invention consists of a colored transparent acrylic bar or hollow tube with a small light source at one end. The light from the light source is transmitted along the bar and produces a bright light stick of nearly any preselected color.

In an alternate embodiment, the light strip of the present invention consists of a pliable electro-luminescent strip attached to a thin bar.

The bar or strip is powered by any suitable device such as a single 9-volt, two AA, or any other combination of batteries which are connected by thin wires to the light source, or can be integrally connected. The bar or strip is quickly and easily attached to the skate by a suitable method such as a small strap that is tightly wrapped around the strip or bar, and attached to the skate by a small screw. The battery is attached to the skate near the end of the light bar or strip by a similar manner. Alternately, hook and loop fasteners can be used in place of the screw and strap.

The light bar or strip is activated by a on/off switch mounted near the battery pack. Alternately, the light bar or strip can simply be connected by a removable connector into the battery power source.

Accordingly, it is an objective of the present invention to provide a bright, colorful, and unobstructed light source for most roller skates.

It is another objective of the present invention to provide a light source that is easy to install in most after market roller skates.

It is yet another objective of the present invention to provide an inexpensive and convenient light source for roller skates.

In accordance with these and other objects which will become apparent hereinafter, the instant invention will now be described with particular reference to the accompanying drawings.

BRIEF DESCRIPTION OF THE DRAWINGS

FIG. 4A is side elevational view of an alternate embodiment of the present invention.

FIG. 4B is an enlarged side elevational view of the area indicated as 4B in FIG. 4A.

DESCRIPTION OF THE PREFERRED EMBODIMENTS

Figure 1A:
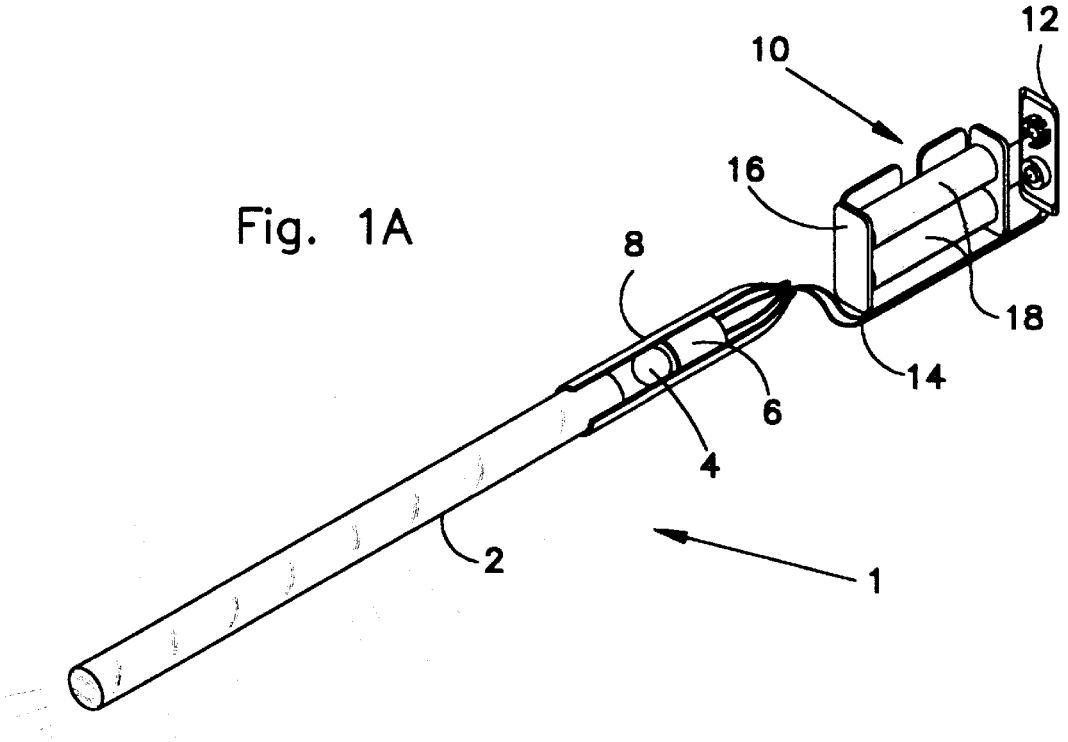
FIG. 1A is a perspective view, in partial cut away, of the present invention.

Referring now to FIG. 1A, the present invention shown generally as light 1, consists mainly of light tube 2, light bulb 4, light bulb socket 6, pliable sheath 8, battery pack 10, battery connector 12, and interconnect wires 14.

Tube 2 is made of a solid, or hollow, transparent, or translucent plastic or acrylic material of a clear or preselected color. The material of tube 2 is selected such that it transmits and refracts light rays received from bulb 4. When bulb 4 is activated, tube 2 brightly glows a specific color which depends on the color of plastic material that is selected.

Pliable sheath 8 is made of an opaque preformed pliable plastic or vinyl. Sheath 8 is sized and molded to tightly hold light socket 6 and light bulb 4 in close proximity with tube 2, and grip wires 14. Should light bulb 4 need replacing, pliable sheath 8 can be pulled from tube 2 and slid back along wires 14 thereby exposing bulb 4 for replacement.

Battery pack 10 is comprised of battery holder 16 and batteries 18. Batteries 18 are preferably size AA or 9-volt of either carbon or alkaline, or other similar common and easily obtained battery type. Battery connector 12 plugs into battery pack 10 to activate light bulb 4. In an alternate embodiment, shown in FIGS. 4A and 4B, a switch 46 is used to activate and deactivate light 1.

Figure 1B:
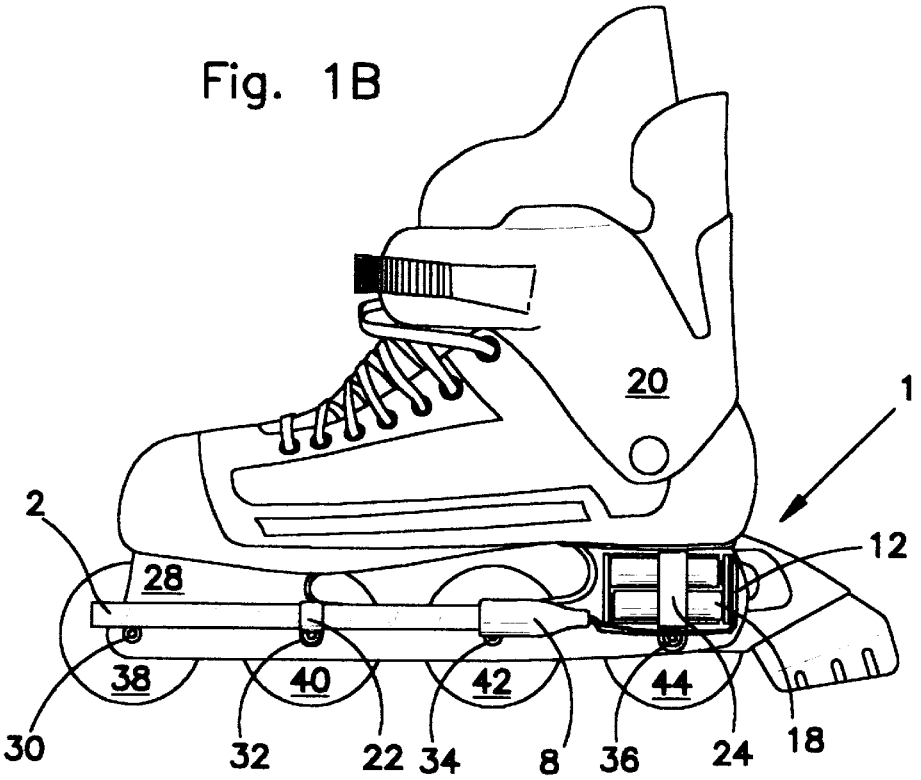
FIG. 1B is a side elevational view of the present invention shown attached to on an in-line roller skate.
Figure 2:
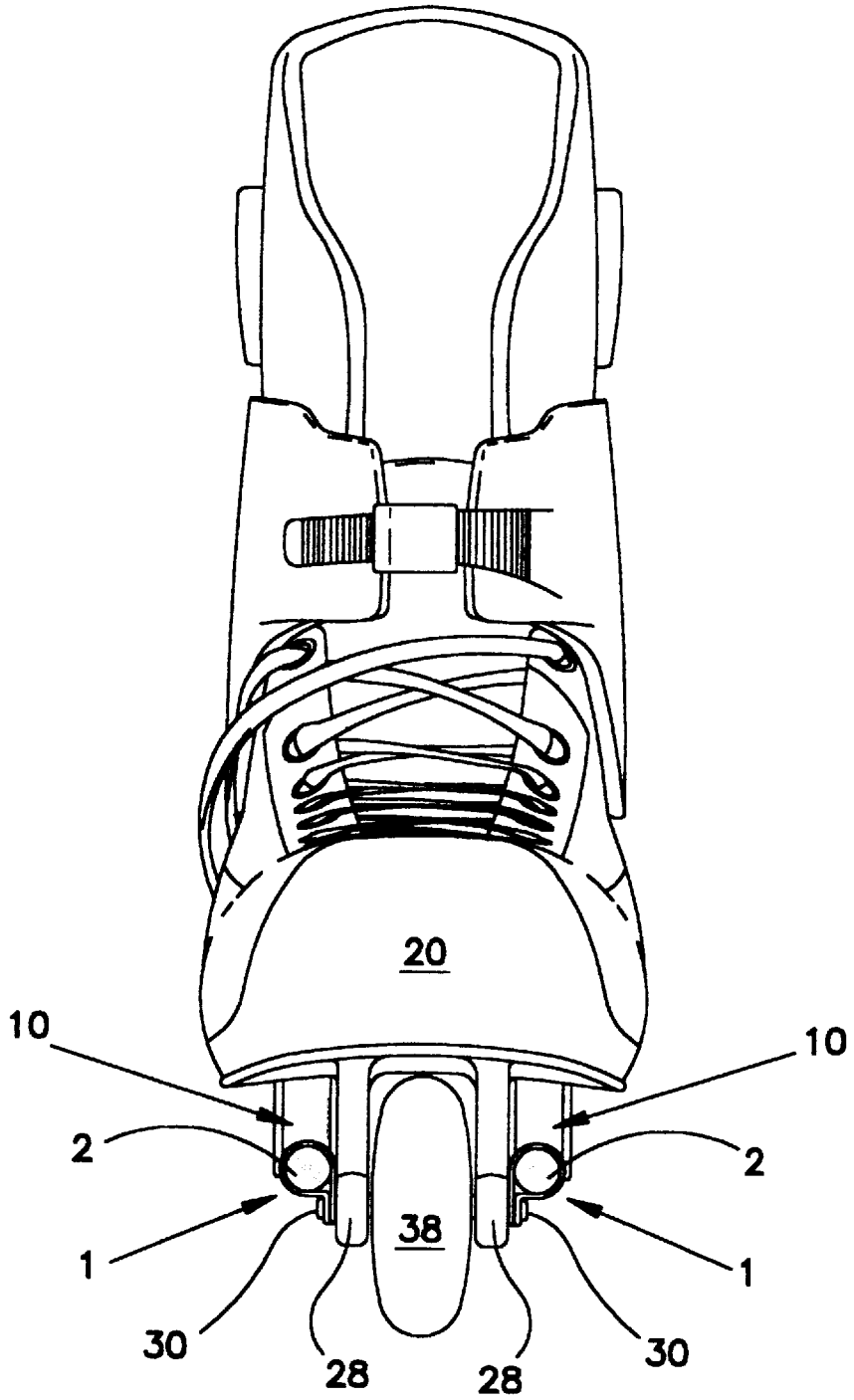
FIG. 2 is a front elevational view of the present invention shown attached to either side of an in-line roller skate.

FIG. 1B shows light 1 in position on in-line roller skate 20. In-line roller skates are used as an example only, the present invention is not limited to use on an in-line skate, but can be used on most roller skates, ice skates, skate boards, bicycles, and other similar items. FIG. 2 shows light 1 in use on both sides of in-line skate 20. Light 1 can be used on both sides of a skate or on only one side, depending on the user's preference. The description and example of installation herein is given for one side of one skate, but is applicable to multiple skates and sides. However, the figures would be a mirror image in a description of installation on the opposite side of the example skate.

Figure 3:
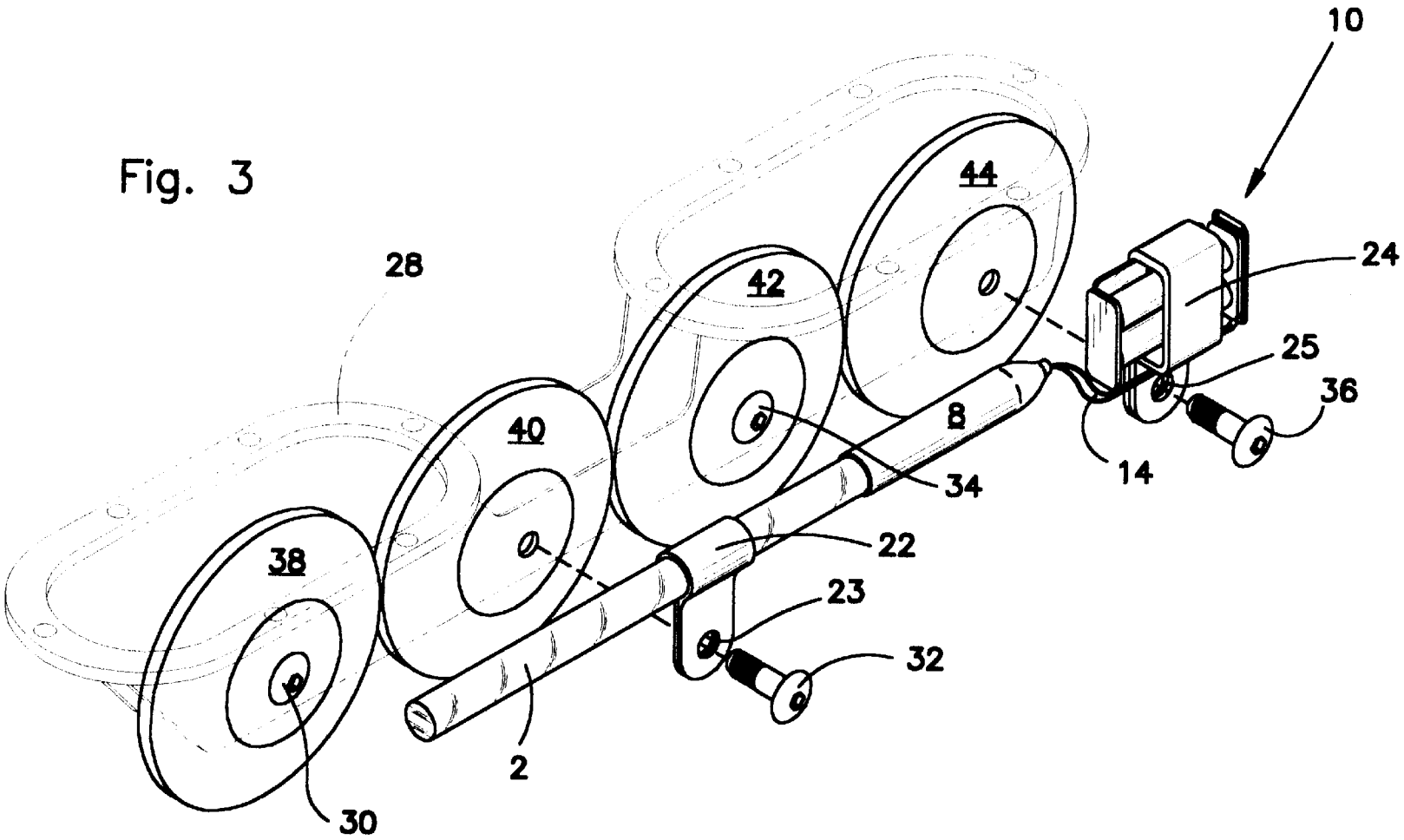
FIG. 3 is an exploded perspective view of the present invention.

Light 1 is attached to skate 20 by any suitable means such as straps 22 and 24, which are made of a suitable material such as heavy duty plastic or vinyl. As best seen in FIG. 3, strap 22 is sized to fit snugly around light tube 2 and is bolted through aperture 23 to frame 28 by bolt 32. Strap 24 is sized to snugly fit battery pack 10 and is bolted through aperture 25 to frame 28 by bolt 36. Bolts 30, 32, 34, and 36, used to attach wheels 38, 40, 42, and 44 to frame 28, are standard bolts that come with skate 20 when purchased. Bolts 32 and 36, used to attach wheels 40 and 44 to frame 28, are removed and reutilized to attach light 1 to frame 28. In some applications, bolts 32 and 36 may need to be replaced with longer bolts.

If skate 20 were a different model, perhaps one that had 5 wheels instead of four (not shown), the selection of wheel 40 and wheel 44, on which to bolt light 1, could be altered. The selection of wheel locations would be made to position light 1 in a desired location. In addition, to provide further adjustment, the position of strap 22 can be altered on light tube 2, and/or multiple straps 22 can be used. (not shown).

FIGS. 4A and 4B shows an alternate embodiment of the present invention. Instead of plugging and unplugging connector 12 to battery pack 10 to activate and deactivate light 1, power switch 46 can be utilized. In this embodiment, connector 12, best shown in FIG. 1A, is replaced by switch 46, as shown in FIG. 4B.

Figure 5A:
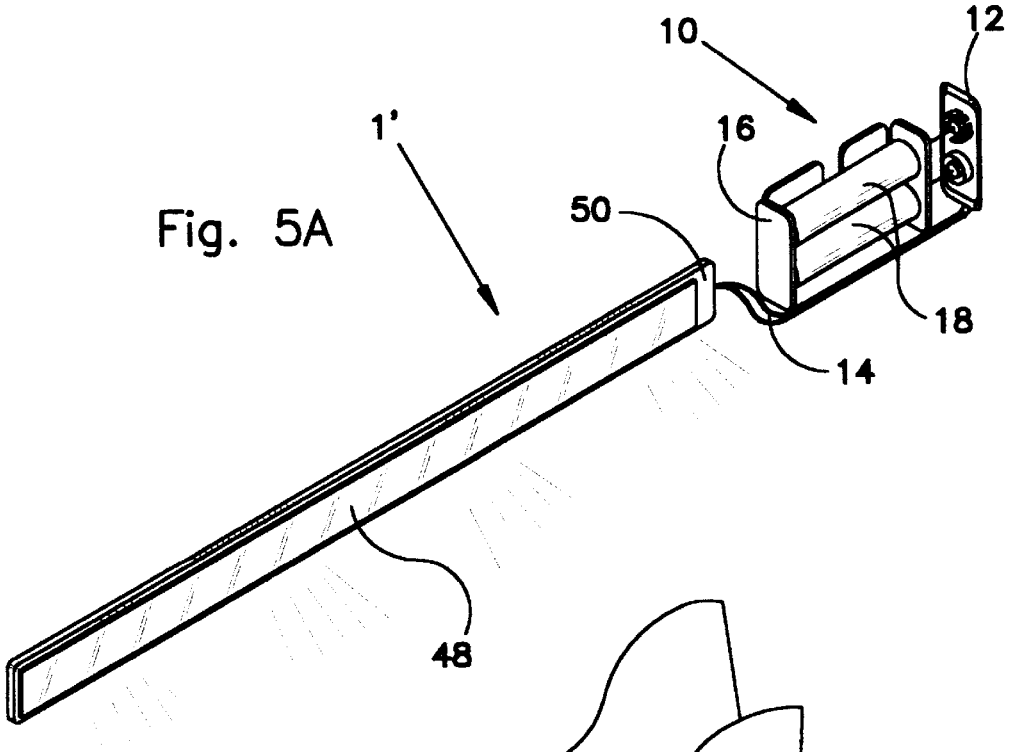
FIG. 5A is a perspective view of an alternate embodiment of the present invention.
Figure 5B:
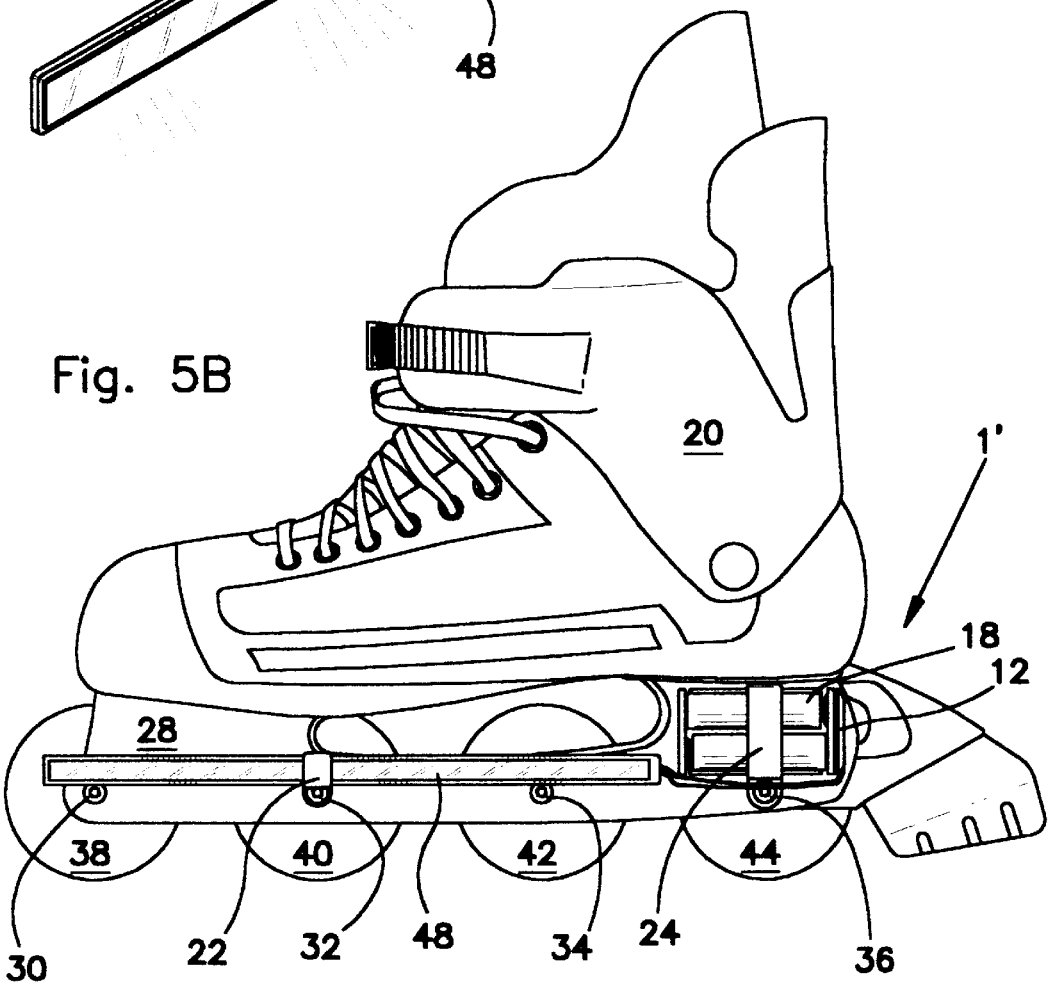
FIG. 5B is a side elevational view of the embodiment shown in FIG. 5A shown attached to an in-line roller skate.

FIGS. 5A and 5B show another alternate embodiment of the present invention. In this embodiment shown generally as 1', light tube 2 is replaced by electro-luminescent light strip 48. Electro-luminescent (EL) light strips are known in the art and are typically sold commercially to runners and others that want to be more visible after dark than is possible solely by the use of reflective material. For example, Root International, Inc., 6625 N. Anderson Road, Tampa, Fla. 33634, sells products for runners, cyclists, workmen, and others, that incorporate battery powered flexible electro-luminescent strips into belts and vests.

Pliable EL light strip 48 is bonded to thin bar 50 by any suitable bonding material such as glue. Bar 50 can be any suitable material such as metal or plastic and is used merely to maintain rigidity of EL strip 48 and ease attachment to skate 20.

As seen in FIG. 5B, the attachment of light 1' to skate 20 is similar to attachment of light 1 to skate 20 as previously discussed. The only difference being strip 22 is sized to fit EL strip 48 and bar 50 instead of light tube 2.

Similar to light 1, the embodiment 1' of FIGS. 5A and SB, can be utilized with connector 12 as shown, or with switch 46 (not shown).

Figure 6A:
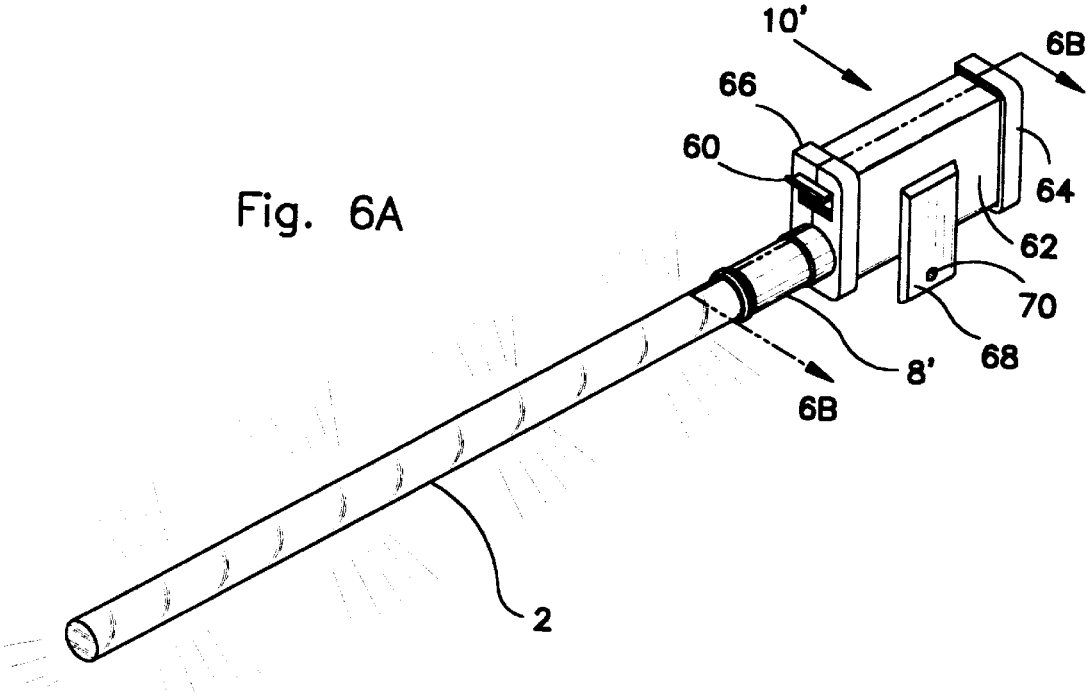
FIG. 6A is a perspective view of the preferred embodiment of the present invention.
Figure 6B:
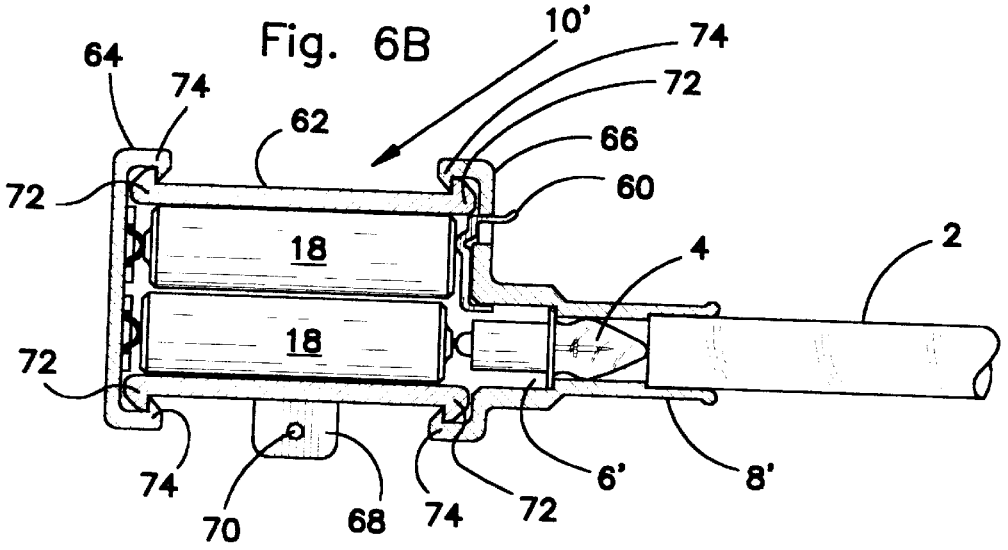
FIG. 6B is a cross-sectional view taken along line 6B—6B of FIG. 6A.

Referring now to FIGS. 6A and 6B, the preferred embodiment of the present invention is shown. This embodiment generally comprises housing 10', batteries 18, microswitch 60, housing body 62, end plates 64 and 66, and attachment tab 68. End plate 66 holds light bulb 4 in place at integral socket 6', and includes holder 8'. Holder 8' is sized to securely hold light rod 2 in place and adjacent to bulb 4.

Housing body 62, end plates 64 and 66, and attachment tab 68 can be made of any suitably material such as plastic. End plates 64 and 66 are attached to housing body 62 in any suitable manner, but preferably in a removable manner to allow battery 18 or light 4 replacement, such as mating snaps 72 and 74. Switch 60 can be a small microswitch or a mechanical switch as shown. This embodiment eliminates the use of interconnecting wires 14 used in the other embodiments described herein.

Tab 68 includes aperture 70 for use in attaching the device to a skate. Housing body 62 can be attached to end plates 64 and 66 in reverse manner from that shown in FIGS. 6A and 6B such that during assembly of housing 10', tab 68 can be selectively located on either side of housing 10' for attachment on the left or right side of a skate.

Installation of this embodiment is accomplished by utilizing a skate rear wheel screw, such as 36 shown in FIG. 3, to pass through aperture 70 and be tightened securely into the skate thereby attaching housing 10' to the skate. Light bar 2 is then placed securely in holder 8'. A strap clamp, shown as 22 in FIG. 3, which can be purchased at most hardware stores, can optionally be used in similar fashion, using screw 32 for example, to further secure light rod 2.

An alternate installation method, which can be used with all the embodiments described herein above, is to position and drill a small mounting hole into a skate wheel chassis, such as 28 shown in FIG. 3, and use a small screw and nut, or a self tapping screw, (not shown) to mount housing 10'. Light bar 2 is then securely inserted into holder 8'. If using optional clamp 22, a second hole can be drilled into the chassis to attach clamp 22 in similar fashion.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A roller skate lighting device comprising:

an elongated display member formed of a light-transmissive material, said elongated display member having a longitudinal axis mountable to a roller skate having at least two rollers, wherein said longitudinal axis is perpendicular to an axis of rotation of at least one of said rollers;

means for lighting said display member, said means for lighting removably disposed adjacent a first end of said display member for lighting said elongated display member substantially from said first end to a second end; and, means for powering said means for lighting, wherein said display member is mountable to a mounting bolt of a first roller of said roller skate.

2. The device of claim 1 wherein said means for powering is mountable to a mounting bolt of a second roller of said roller skate.

3. The device of claim 2 wherein said display member and said means for lighting have a length in combination essentially equal to a length of said roller skate.

4. A skate lighting device for a skate having a plurality of in-line wheels each mounted on an individual axle, comprising:

an electro-luminescent light strip mounted on an elongated rigid bar member, said elongated rigid bar member mountable on a first axle of the skate;

means for powering said light strip connected to said light strip and mountable to a second axle of the skate.

5. The device of claim 4 wherein said means for powering is at least one battery.

6. The device of claim 4 wherein said means for powering includes an on/off power switch.

7. The device of claim 4 wherein, said light strip and said means for powering have, in combination, a length essentially equal to a length of said roller skate.

8. The device of claim 4 wherein said bar member is made of metal.

9. The device of claim 4 wherein said bar member is made of plastic.

* * * * *